US009625877B2

(12) United States Patent
Yamashita et al.

(10) Patent No.: US 9,625,877 B2
(45) Date of Patent: Apr. 18, 2017

(54) IMAGE FORMING APPARATUS HAVING AIR BLOWER FOR COOLING

(71) Applicant: KYOCERA Document Solutions Inc., Osaka-shi, Osaka (JP)

(72) Inventors: Kazuya Yamashita, Osaka (JP); Masahiko Fukano, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/068,356

(22) Filed: Mar. 11, 2016

(65) Prior Publication Data

US 2016/0274537 A1 Sep. 22, 2016

(30) Foreign Application Priority Data

Mar. 17, 2015 (JP) ..... 2015-053841

(51) Int. Cl.
*G03G 15/00* (2006.01)
*G03G 21/20* (2006.01)
*G03G 21/16* (2006.01)

(52) U.S. Cl.
CPC ..... *G03G 21/206* (2013.01); *G03G 21/1604* (2013.01)

(58) Field of Classification Search
CPC ..... G03G 21/206; G03G 21/1619; G03G 2215/00721
USPC ..... 399/92, 98
See application file for complete search history.

(56) References Cited

U.S. PATENT DOCUMENTS 6,308,024 B1 * 10/2001 Nakayama ..... B41J 29/12 399/92
2011/0280609 A1 * 11/2011 Nakazawa ..... G03G 21/206 399/92

FOREIGN PATENT DOCUMENTS

JP 2012150362 A 8/2012

* cited by examiner

*Primary Examiner* — Walter L Lindsay, Jr.
*Assistant Examiner* — Jessica L Eley
(74) *Attorney, Agent, or Firm* — Alleman Hall McCoy Russell & Tuttle LLP

(57) ABSTRACT

An image forming apparatus includes a transfer portion, a fixing portion, a container mounting portion, an air blower, and an air duct portion. The transfer portion has a transfer belt extending in a first direction. The fixing portion is provided on one side in the first direction with respect to the transfer portion. The container mounting portion is provided so as to be spaced via a first air passage having a predetermined interval in a second direction perpendicular to the transfer belt and perpendicular to the first direction. In the container mounting portion, one or a plurality of toner containers containing a developer are mounted. The air blower is provided on another side in the first direction with respect to the container mounting portion, and configured to send air to the first air passage. The air duct portion guides air sent from the air blower, to the first air passage.

20 Claims, 9 Drawing Sheets

IMAGE FORMING APPARATUS HAVING AIR BLOWER FOR COOLING

INCORPORATION BY REFERENCE

This application is based upon and claims the benefit of priority from the corresponding Japanese Patent Application No. 2015-053841 filed on Mar. 17, 2015, the entire contents of which are incorporated herein by reference.

BACKGROUND

The present disclosure relates to an image forming apparatus having an air blower for cooling a transfer belt.

There is known an image forming apparatus such as a copy machine or a printer for forming an image on a sheet member on the basis of electrophotography. Inside the image forming apparatus of this type, various members as sources that generate heat are provided. For example, a heating device for melting toner, a motor for driving a roller that conveys a sheet member, a motor for agitating toner in a toner container, a motor for rotating a transfer belt, a photosensitive drum, and the like, are provided inside the image forming apparatus. If the toner container is influenced by heat from such heat sources, the temperature of toner inside the toner container increases, and the fluidity of the toner decreases. In order to cause the toner to adhere to the photosensitive drum, it is necessary to charge the toner. However, if the temperature of toner increases, the charge amount of the toner decreases, so that the adhesion property of the toner to the photosensitive drum deteriorates. If the transfer belt is heated by heat from the heat sources, the charge amount of toner transferred to the transfer belt excessively decreases, so that the transfer property of the toner to a sheet member might deteriorate.

Conventionally, there is known an image forming apparatus capable of discharging heat of a transfer belt and preventing heat generated from a fixing portion from transferring to a transfer portion.

SUMMARY

An image forming apparatus according to one aspect of the present disclosure includes a transfer portion, a fixing portion, a container mounting portion, an air blower, and an air duct portion. The transfer portion has a transfer belt extending in a predetermined first direction. The fixing portion is provided on one side in the first direction with respect to the transfer portion. The container mounting portion is provided so as to be spaced via a first air passage having a predetermined interval in a second direction perpendicular to the transfer belt and perpendicular to the first direction. In the container mounting portion, one or a plurality of toner containers containing a developer are mounted. The air blower is provided on another side in the first direction with respect to the container mounting portion, and configured to send air to the first air passage. The air duct portion is provided between the air blower and the container mounting portion and configured to guide air sent from the air blower, to the first air passage.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
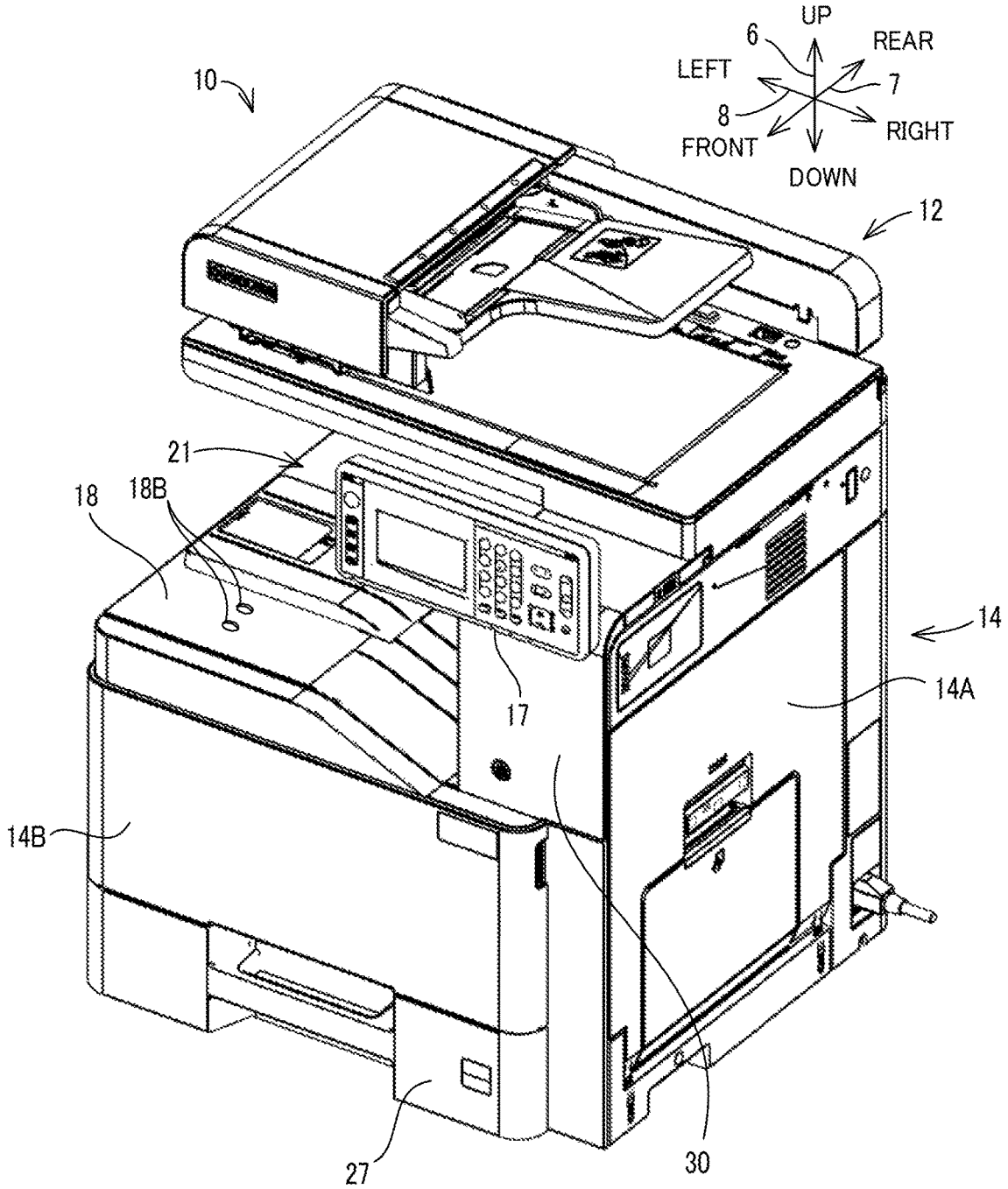
FIG. 1 is a perspective view showing an image forming apparatus according to an embodiment of the present disclosure.

Hereinafter, embodiments of the present disclosure will be described while referring to the drawings as necessary. The embodiments described below are merely examples in which the present disclosure is embodied, and are not intended to limit the technical scope of the present disclosure.

For convenience of description, the vertical direction when an image forming apparatus 10 is installed in a usable state (state shown in FIG. 1) is defined as an up-down direction 6. In addition, a front-rear direction 7 is defined such that a side surface on which an operation display portion 17 is provided is a front surface (forward surface) in this installed state. In addition, a right-left direction 8 is defined with reference to the front surface of the image forming apparatus 10 in this installed state.

As shown in FIG. 1, the image forming apparatus 10 is a multifunction peripheral of a so-called in-body sheet discharge type.

The image forming apparatus 10 includes an image reading portion 12 and an image forming portion 14.

A sheet discharge space 21 is provided above the image forming portion 14. As shown in FIG. 1, the sheet discharge space 21 opens at the front side and the left side. The rear side of the sheet discharge space 21 is not opened but is closed by a back cover (not shown). A sheet discharge portion 30 is provided on the right side of the sheet discharge space 21. The right side of the sheet discharge space 21 is closed by the sheet discharge portion 30.

The image forming portion 14 includes a housing 14A as an apparatus body. Inside the housing 14A, portions composing the image forming portion 14 are provided. The housing 14A is composed of an external frame covering the entirety of the image forming portion 14, and an internal frame supporting the portions composing the image forming portion 14. The housing 14A has substantially a cuboid shape as a whole.

Figure 2:
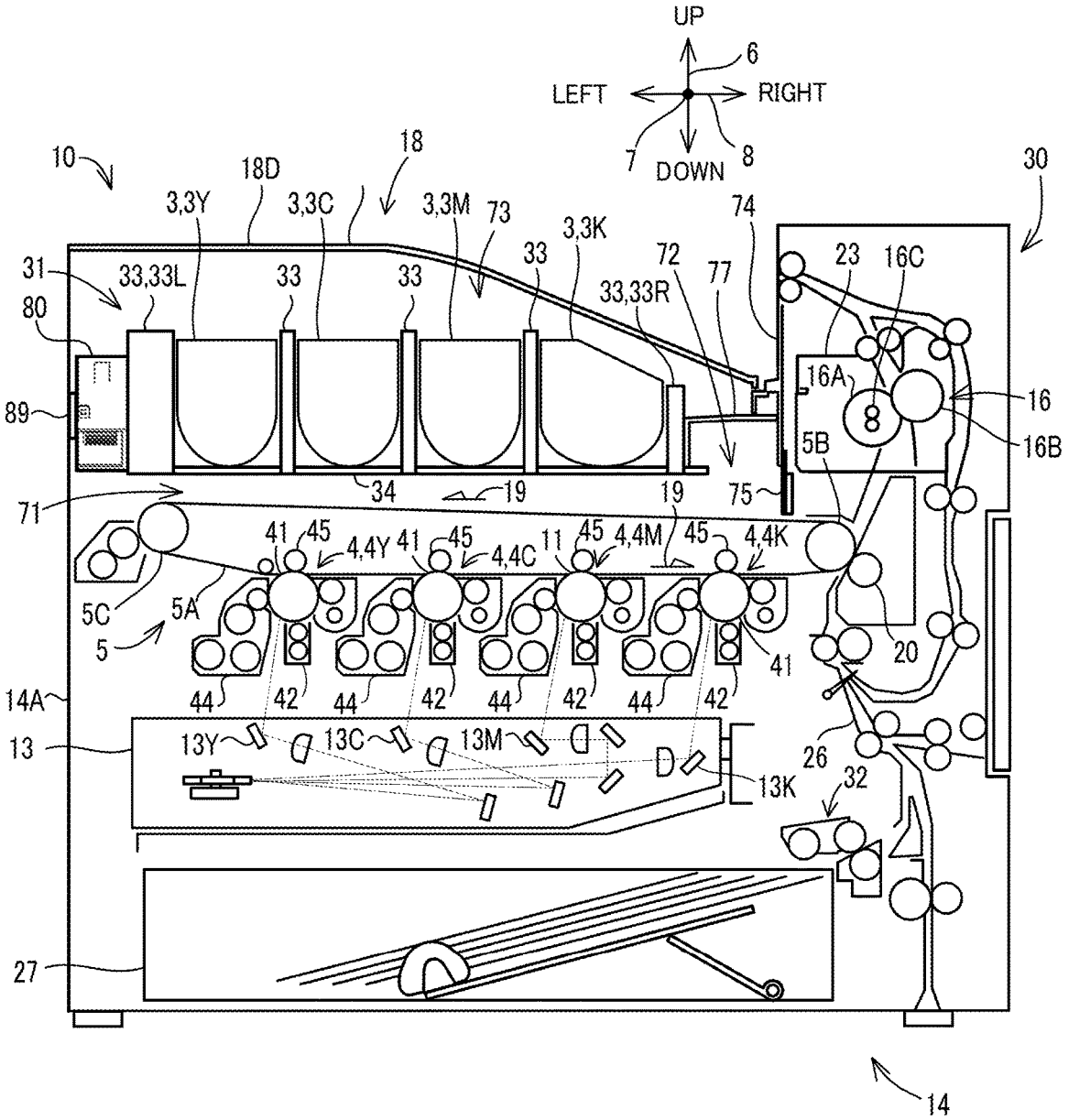
FIG. 2 is a view showing the internal configuration of an image forming portion provided in the image forming apparatus in FIG. 1.

In FIG. 2, the image reading portion 12 is not shown. The image forming portion 14 forms a color image on a sheet member on the basis of a so-called tandem method. As shown in FIG. 2, the image forming portion 14 includes a plurality of image forming units 4, an intermediate transfer unit 5 (an example of a transfer portion of the present disclosure), a laser scanning unit 13, a secondary transfer roller 20, a fixing device 16 (an example of a fixing portion of the present disclosure), a sheet discharge tray 18 (an example of a discharged sheet retainer of the present disclosure), a sheet feed cassette 27, a sheet feed unit 32, the operation display portion 17 (see FIG. 1), a conveyance path 26, a container unit 31 (an example of a container mounting portion of the present disclosure), a blower fan 80 (an example of an air blower of the present disclosure), a control portion (not shown), and the like. In the container unit 31, a plurality of toner containers 3 are detachably mounted. The image forming portion 14 forms a monochrome image or a color image on a sheet member such as a print sheet, using a print material such as toner, on the basis of inputted image data.

The sheet feed unit 32 takes out, one by one, sheet members stacked in the sheet feed cassette 27, and feeds the sheet member to the conveyance path 26.

Image forming units 4 (4Y, 4C, 4M, 4K) are provided under the intermediate transfer unit 5. Each image forming unit 4 includes a photosensitive drum 41, a charging device 42, a developing device 44, a primary transfer roller 45, and the like.

In the present embodiment, four image forming units 4 are provided, and therefore four photosensitive drums 41 are provided in the housing 14A. Each photosensitive drum 41 is rotatably supported by the internal frame of the housing 14A, and the like. In the housing 14A, a transmission mechanism (not shown) such as a gear train for transmitting power to a rotary shaft of each photosensitive drum 41 is provided. A drive force from a motor is transmitted to the transmission mechanism, whereby each photosensitive drum 41 is rotated in a predetermined direction. The photosensitive drum 41 carries, on the surface thereof, a toner image formed by the developing device 44 performing a development process.

As shown in FIG. 2, the intermediate transfer unit 5 includes a transfer belt 5A, a drive roller 5B, and a driven roller 5C. The transfer belt 5A is provided on the upper side of the photosensitive drums 41. The transfer belt 5A is an endless loop belt, and is made from a resin member having electric conductivity. The transfer belt 5A extends in a predetermined first direction. Specifically, the transfer belt 5A is substantially horizontal when the image forming apparatus 10 is installed, and extends in the right-left direction 8 (first direction). Both ends in the right-left direction 8 of the transfer belt 5A are rotatably supported by the drive roller 5B and the driven roller 5C which are separated from each other in the right-left direction 8. The transfer belt 5A is supported so as to be stretched between the drive roller 5B and the driven roller 5C.

The transfer belt 5A is a belt member onto which toner images for the respective colors formed on the photosensitive drums 41 of the image forming units 4 are transferred. By being supported by the drive roller 5B and the driven roller 5C, the transfer belt 5A can move (run) in a direction indicated by an arrow 19 while the surface thereof contacts with the surfaces of the photosensitive drums 41. While the surface of the transfer belt 5A passes between the photosensitive drums 41 and the primary transfer rollers 45, toner images are sequentially transferred from the photosensitive drums 41 in an overlapped manner.

The image forming units 4 form a color image on the basis of a tandem method. The plurality of image forming units 4 are arranged along the running direction (horizontal direction) of the transfer belt 5A. From the left side to the right side of the transfer belt 5A, the image forming unit 4Y for yellow, the image forming unit 4C for cyan, the image forming unit 4M for magenta, and the image forming unit 4K for black are arranged in this order in a row.

The secondary transfer roller 20 is provided so as to be opposed to the drive roller 5B via the conveyance path 26 extending in the up-down direction. By a transfer potential being applied to the secondary transfer roller 20, a toner image on the transfer belt 5A is transferred to a sheet member. The sheet member on which the toner image has been transferred is conveyed to the fixing device 16.

The fixing device 16 is provided to the right side (one side in the first direction) with respect to the intermediate transfer unit 5. In detail, the fixing device 16 is provided to the right side with respect to the drive roller 5B and upward of the secondary transfer roller 20. The fixing device 16 heats the toner image transferred to the sheet member, to fix the toner image on the sheet member. The fixing device 16 is provided substantially at the same height as toner containers 3 described later in the horizontal direction. As shown in FIG. 2, the fixing device 16 is provided near the right end of the housing 14A. The fixing device 16 includes a housing 23, a heating roller 16A, and a pressure roller 16B. The heating roller 16A and the pressure roller 16B are provided in the housing 23.

The heating roller 16A is heated to a predetermined temperature that allows the toner to be fixed, by a heating device 16C provided inside the heating roller 16A. The pressure roller 16B is opposed to the heating roller 16A. The heating roller 16A is provided on the left side of the conveyance path 26 extending in the up-down direction, and the pressure roller 16B is provided on the right side of the conveyance path 26. The pressure roller 16B is energized by an elastic member (not shown), to be pressed to contact with the heating roller 16A. The sheet member conveyed to the fixing device 16 is conveyed while being held by the heating roller 16A and the pressure roller 16B. In this conveyance, heat is transferred from the heating roller 16A to the toner image transferred to the sheet member, whereby the toner image is heated. Thus, the toner image is melted to be fixed on the sheet member. Thereafter, the sheet member is discharged to the sheet discharge tray 18.

The sheet discharge tray 18 is provided in the sheet discharge space 21. As shown in FIG. 2, the sheet discharge tray 18 is provided above the intermediate transfer unit 5. In detail, the sheet discharge tray 18 is provided above the toner containers 3 described later so as to cover the top surfaces of the toner containers 3. A space 73 is formed between the sheet discharge tray 18 and the top surfaces of the toner containers 3. The space 73 is communicated with a second air passage 72 described later. The sheet discharge tray 18 retains a sheet member that has passed through the fixing device 16 and has been discharged to the outside from the sheet discharge portion 30. On the sheet discharge tray 18, discharged sheet members are stacked so as to be piled upward. On the top surface (sheet stack surface) of the sheet discharge tray 18, plural rails of ribs 18C extending in the right-left direction 8 are formed. The plurality of ribs 18C are arranged at predetermined intervals in the front-rear direction 7. A sheet member discharged to the sheet discharge tray 18 is supported by the top ends of the ribs 18C.

The container unit 31 is provided above the intermediate transfer unit 5. The container unit 31 is provided in the internal frame of the housing 14A. The container unit 31 is provided at a position separated in a second direction (up-down direction 6) which is perpendicular to the top surface of the upper portion of the transfer belt 5A and is perpendicular to the predetermined first direction (right-left direction 8). Specifically, the container unit 31 is provided at a position separated upward by a predetermined interval from the top surface of the upper portion of the transfer belt 5A. The gap between the container unit 31 and the transfer belt 5A is a first air passage 71 through which cooling air sent from the blower fan 80 described later passes. The blower fan 80 is provided at the left of the first air passage 71.

The container unit 31 is configured to allow the plurality of toner containers 3 to be mounted therein. The container unit 31 has four storage chambers for storing the toner containers 3, and supports the toner containers 3 so as to be slidable in the front-rear direction 7 in the storage chambers. The four storage chambers are arranged along the right-left direction 8. Specifically, the container unit 31 has five guide portions 33 serving as partitions between the storage chambers in the right-left direction 8. The guide portions 33 stand upward from a bottom plate 34 of the container unit 31. Spaces between the guide portions 33 correspond to the storage chambers. The interval (width of each storage chamber) between the guide portions 33 corresponds to the width of each toner container 3. Therefore, when the toner containers 3 are stored in the storage chambers, the guide portions 33 can support side surfaces of each toner container. Of the plurality of guide portions 33, a guide portion 33L at the leftmost position supports the blower fan 80, and also serves as an air duct for guiding air sent from the blower fan 80, to the first air passage 71. The guide portion 33L is an example of an air duct portion of the present disclosure. The guide portion 33L will be described later.

Each toner container 3 is for containing toner therein, and is detachably supported by the container unit 31. Specifically, the toner container 3 can be mounted in a specified storage chamber in the container unit 31, from the front side of the housing 14A. When a front cover 14B (see FIG. 1) of the housing 14A is opened, the front side of the container unit 31 is exposed. Then, the toner container 3 is inserted into the storage chamber of the container unit 31 from the front to the rear, whereby the toner container 3 is mounted in the storage chamber of the container unit 31. When each toner container 3 is mounted in the container unit 31, toner can be supplied from the toner container 3 to the developing device 44 through a toner conveyance path (not shown).

When the toner container 3 is inserted into the storage chamber, the guide portions 33 positioned at both sides of the storage chamber guide the toner container 3 backward (insertion direction). When the toner container 3 is extracted from the storage chamber, the guide portions 33 guide the toner container 3 forward (extraction direction). That is, the guide portions 33 support side surfaces of the toner container 3 so that the side surfaces can be guided in the insertion/extraction direction (front-rear direction 7) of the toner container 3. The insertion/extraction direction (front-rear direction 7) is an example of a third direction of the present disclosure in which the side surfaces of the toner container 3 are guided and which are perpendicular to the right-left direction 8 (first direction) and the up-down direction 6 (second direction).

The plurality of toner containers 3 are arranged along the running direction (horizontal direction) of the transfer belt 5A. From the left side to the right side of the transfer belt 5A, a toner container 3Y for yellow toner, a toner container 3C for cyan toner, a toner container 3M for magenta toner, and a toner container 3K for black toner are arranged in this order in a row. That is, the plurality of toner containers 3 are arranged in the right-left direction 8 in which the transfer belt 5A extends. Of the plurality of toner containers 3, the toner container 3K is located at the rightmost position. The toner container 3K contains black toner which is used highly frequently, and has a larger capacity and a larger size as compared to the other toner containers 3.

As shown in FIG. 2, in the present embodiment, the toner container 3K is adjacent to the fixing device 16. Specifically, the toner container 3K is provided at a position separated leftward by a predetermined interval from the fixing device 16. Of the plurality of toner containers 3, the toner container 3K is the closest to the fixing device 16. A space between the toner container 3K and the fixing device 16 forms the second air passage 72. The second air passage 72 is a passage through which cooling air sent from the blower fan 80 described later passes. The second air passage 72 is defined by a rightmost guide portion 33R and a side plate 74 (an example of a side plate portion of the present disclosure), and extends in the up-down direction 6 across the front-rear direction 7.

The side plate 74 forms a part of the housing 14A, and is a plate member forming a left side surface of the sheet discharge portion 30. The side plate 74 is formed across the front-rear direction 7 and extends in the up-down direction 6. The side plate 74 serves as a partition between the second air passage 72 and the fixing device 16, and forms a right side surface of the second air passage 72. The lower side of the side plate 74 extends toward the transfer belt 5A. A lower end 74A of the side plate 74 does not reach the transfer belt 5A, and a gap narrower in the up-down direction 6 than the first air passage 71 is formed between the lower end 74A and the transfer belt 5A.

In a conventional image forming apparatus, air sent from the blower fan 80 flows along the top surface of the transfer belt 5A, then, flows through the gap between the intermediate transfer unit 5 and the fixing device 16 to the fixing device 16 side, and on the fixing device 16 side, the air is discharged to the outside. Therefore, even though the transfer belt 5A may be effectively cooled, the toner containers 3 are cooled only at their lower portions. That is, the conventional image forming apparatus cannot cool the toner containers 3 sufficiently. In the conventional image forming apparatus, since air flows into the fixing device 16 side, the heating temperature of the heating roller 16A of the fixing device 16 might be decreased. The image forming apparatus 10 of the present disclosure is capable of effectively cooling the toner containers 3 as well as the transfer belt 5A.

Figure 3:
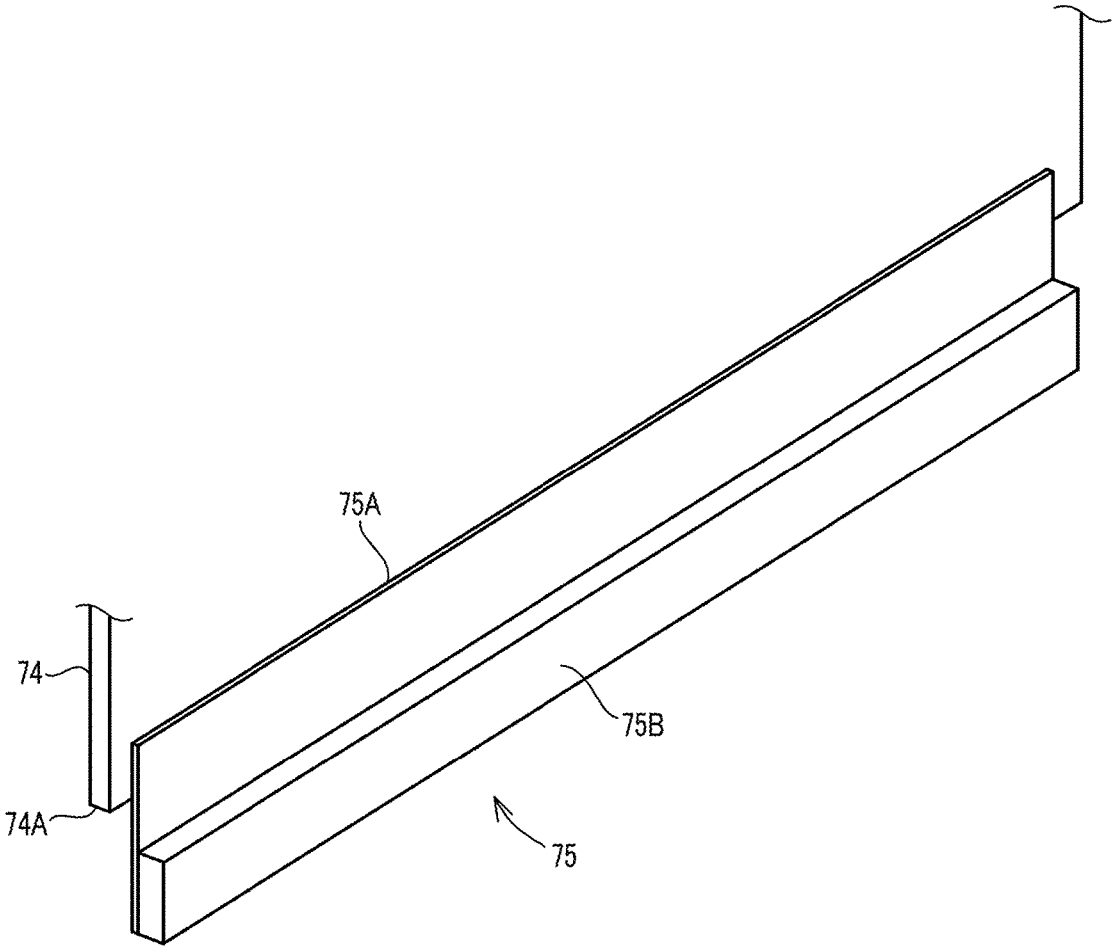
FIG. 3 is a perspective view showing a partition member provided in the image forming portion.

At the lower end 74A on the transfer belt 5A side of the side plate 74, a block portion 75 is provided. The block portion 75 functions as a direction changing portion for changing the direction of air flow sent from the blower fan 80 and passing through the first air passage 71. Specifically, the block portion 75 changes the direction of air flow so that the air flowing from the first air passage 71 flows toward the second air passage 72. In addition, the block portion 75 serves to block air flow so that the air flowing from the first air passage 71 does not flow into the fixing device 16. In the present embodiment, as shown in FIG. 3, the block portion 75 is composed of a film member 75A attached to the lower end 74A, and a sponge member 75B attached to the film member 75A. The film member 75A is formed of a thin member having flexibility, and is, for example, a resin plate member formed of polyethylene terephthalate or the like and having a thin film shape. The film member 75A is formed in a long rectangular shape having a thin width. One end (upper end) in the short-side direction of the film member 75A is fixed to a right side surface of the side plate 74 by fixation means such as bonding. The other end (lower end) in the short-side direction of the film member 75A is close to the transfer belt 5A without contact. At the lower end of the film member 75A, the sponge member 75B formed of a sponge which is an example of a soft material is attached. The sponge member 75B is attached so that the gap between the lower end 74A of the side plate 74 and the transfer belt 5A can be closed.

Since such a block portion 75 is provided on the side plate 74, air flow from the first air passage 71 can be changed to the second air passage 72 side, and the air flow can be blocked so that the air from the first air passage 71 does not flow into the fixing device 16. Since the block portion 75 is composed of the film member 75A and the sponge member 75B, during rotation, even if the transfer belt 5A is displaced in the up-down direction 6 or the transfer belt 5A vibrates, the sponge member 75B contracts, whereby damage to the transfer belt 5A is prevented. When the intermediate transfer unit 5 is exchanged, the film member 75A is greatly bent, whereby the intermediate transfer unit 5 can be extracted rightward without being obstructed by the block portion 75. That is, the intermediate transfer unit 5 can be extracted to the outside without removing the block portion 75.

Figure 4:
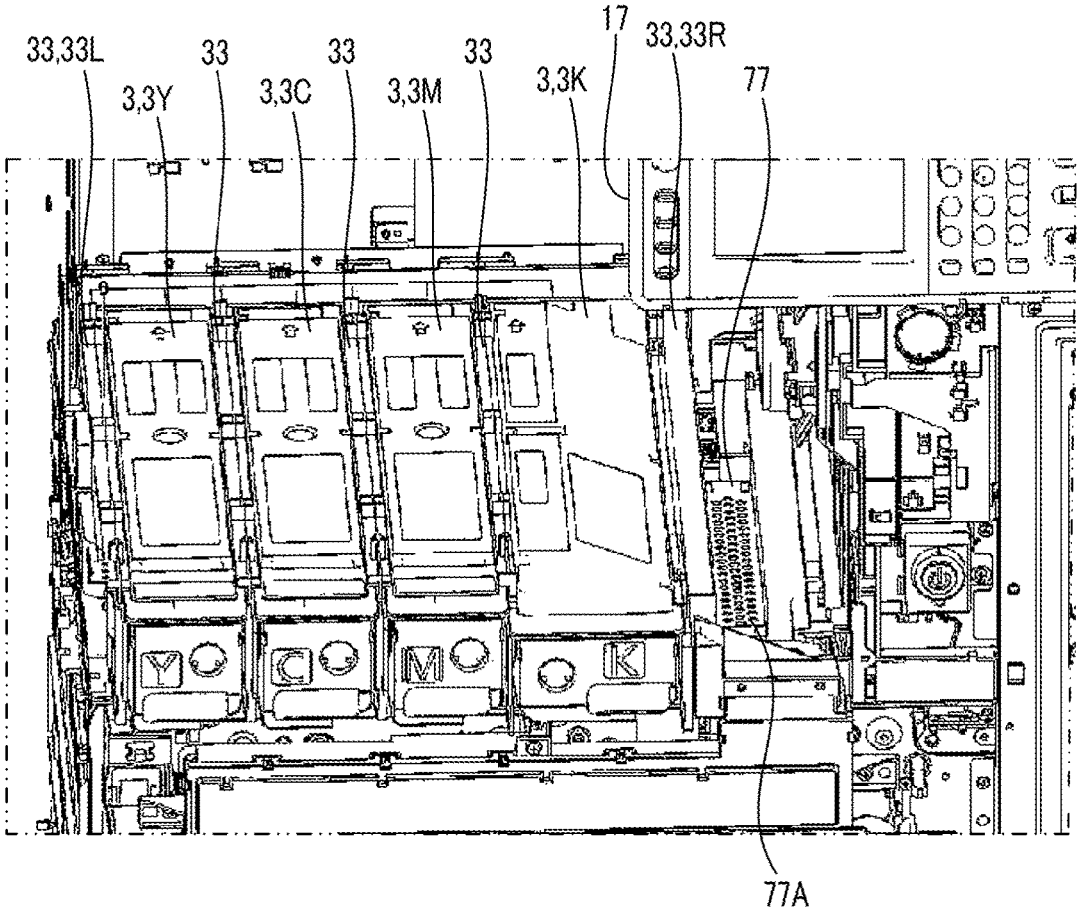
FIG. 4 is a perspective view showing the internal configuration of the image forming portion.

As shown in FIG. 2 and FIG. 4, a partition plate 77 extending in the right-left direction 8 between the guide portion 33R and the side plate 74 is provided in the second air passage 72. The partition plate 77 serves as a partition between the second air passage 72 and the space 73. A plurality of through holes 77A are formed in the partition plate 77. Air flowing into the second air passage 72 flows upward through the through holes 77A, and then the air flows into the space 73 between the toner containers 3 and the sheet discharge tray 18.

Figure 5:
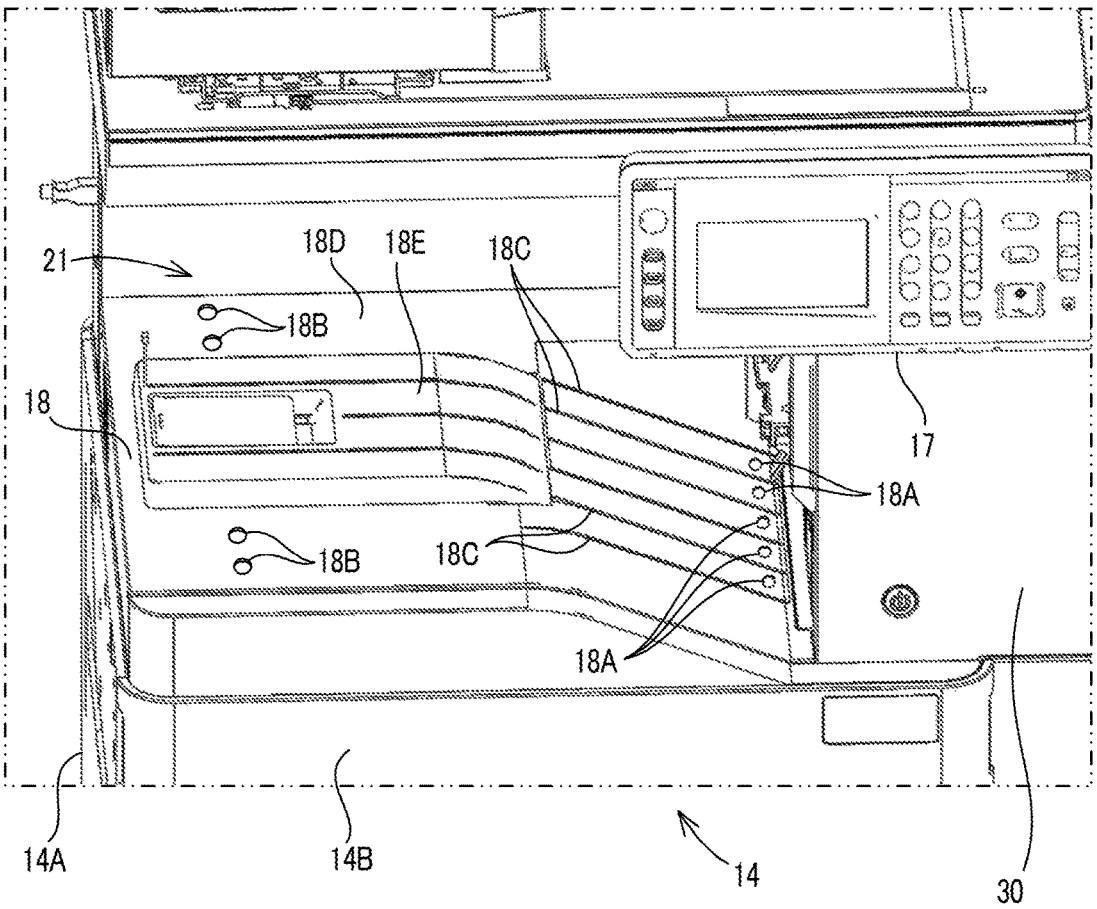
FIG. 5 is a partially enlarged view of a sheet discharge tray provided in the image forming portion.

As shown in FIG. 5, the sheet discharge tray 18 has a plurality of through holes 18A and a plurality of through holes 18B. The through holes 18A and the through holes 18B are an example of a communication portion of the present disclosure, and guide, to the outside, air flowing upward through the second air passage 72 from the first air passage 71.

The plurality of through holes 18A are positioned directly above the second air passage 72. The plurality of through holes 18A are formed between the plurality of ribs 18C in the top surface of the sheet discharge tray 18. Via the plurality of through holes 18A, the second air passage 72 is communicated with the sheet discharge space 21 outside the apparatus. The plurality of through holes 18B are positioned at the left end of the sheet discharge tray 18. The plurality of through holes 18B are formed at both ends in the front-rear direction 7 in the top surface of the sheet discharge tray 18. The space 73 and the sheet discharge space 21 are communicated with each other via the plurality of through holes 18B. In more detail, the plurality of through holes 18B are respectively formed at both ends in the front-rear direction 7 in a flat surface 18D of the top surface of the sheet discharge tray 18. Here, as shown in FIG. 5, the flat surface 18D is a flat surface part located on the left side, of the top surface of the sheet discharge tray 18. At a central part in the front-rear direction 7 on the flat surface 18D, a support surface 18E is provided which has the plurality of ribs 18C arranged at predetermined intervals in the front-rear direction 7. In the flat surface 18D, the plurality of through holes 18B are formed at flat surface parts located on the outer sides in the front-rear direction 7 with respect to the support surface 18E.

Since the through holes 18A are thus formed in the sheet discharge tray 18, air flowing upward through the second air passage 72 passes upward through the through holes 18A to be discharged to the sheet discharge space 21. When there is a sheet member on the sheet discharge tray 18, air discharged from the through holes 18A passes through a gap formed by the ribs 18C between the sheet discharge tray 18 and the sheet member and is guided leftward along the top surface of the sheet discharge tray 18. At this time, the heat of the sheet member discharged to the sheet discharge tray 18 is swiftly cooled by air flowing through the gap, whereby sheet members can be prevented from being adhered to each other by the toner that has been just melted and fixed on the sheet members. Since the through holes 18B are formed in the sheet discharge tray 18, air flowing from the second air passage 72 to the space 73 moves leftward in the space 73 and then passes upward through the through holes 18B to be discharged to the sheet discharge space 21. When the air moves in the space 73, the air contacts with the top surfaces of the plurality of toner containers 3 and the bottom surface of the sheet discharge tray 18, whereby each surface is cooled and thus the toner containers 3 and the sheet discharge tray 18 are cooled. Particularly, the bottom surface, the right side surface, and the top surface of the toner container 3K which is the closest to the fixing device 16 are cooled by air flowing from the first air passage 71 through the second air passage 72 to the space 73. Thus, a great cooling effect can be obtained for the toner container 3K which is the most susceptible to the heat of the fixing device 16. Preferably, the number and the size of the through holes 18A, 18B are determined so as not to hamper the effect of cooling the toner containers 3 by air flow.

Figure 6:
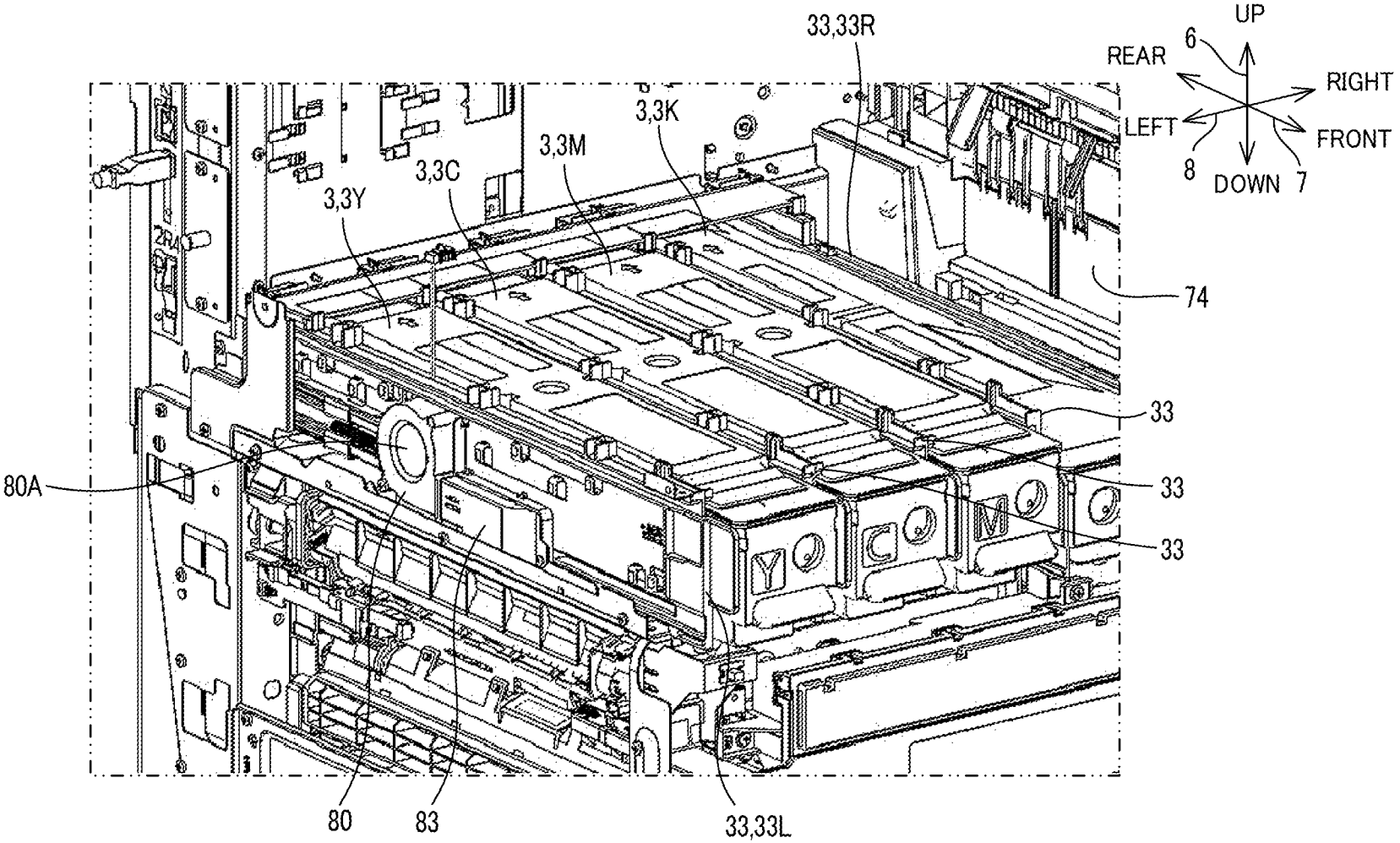
FIG. 6 is a perspective view showing the internal configuration of the image forming portion.
Figure 7A:
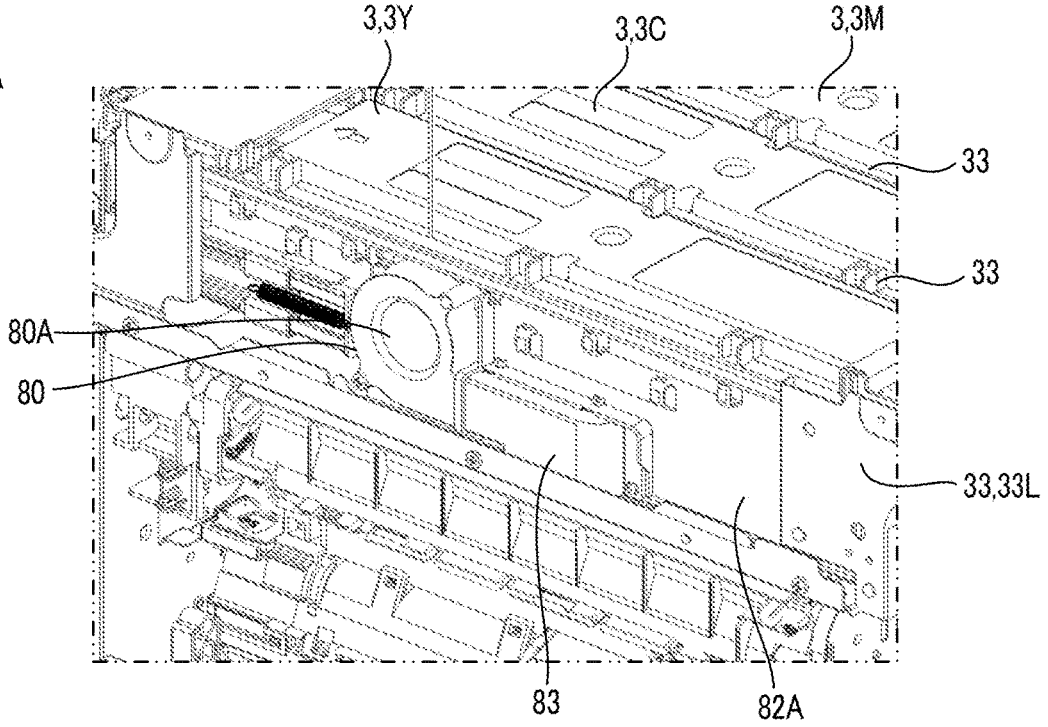
FIG. 7A and FIG. 7B are partially enlarged views of the left side surface of the image forming portion.
Figure 7B:
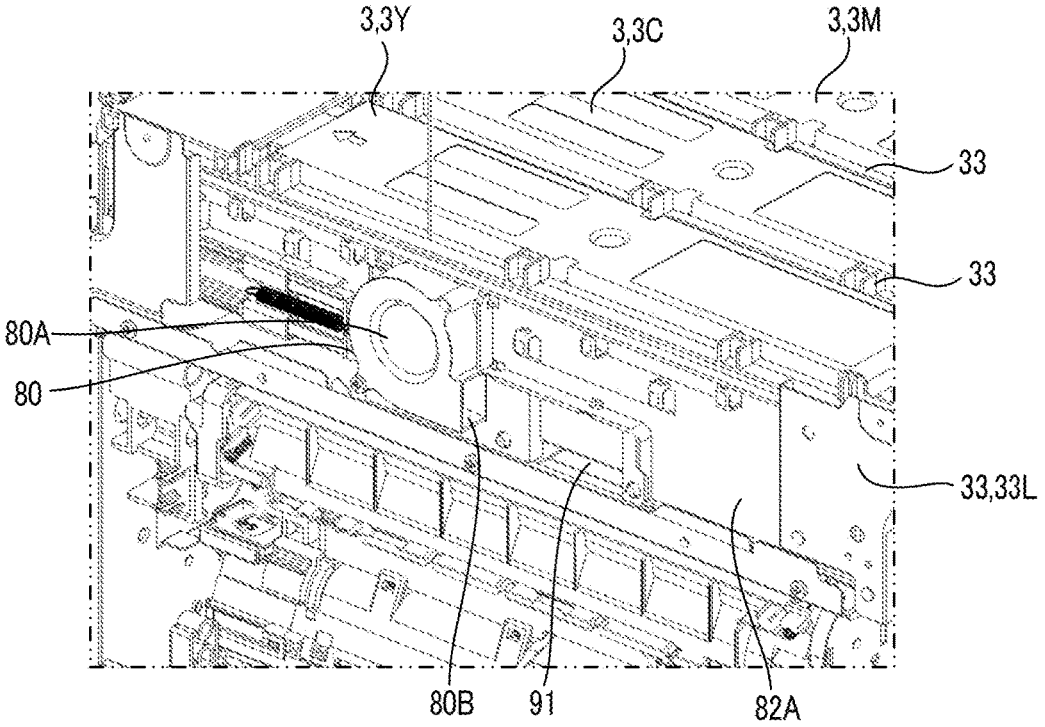

As described above, the first air passage 71 is the gap between the container unit 31 and the transfer belt 5A. That is, the first air passage 71 is defined by the bottom surface of the container unit 31 and the top surface of the transfer belt 5A. As shown in FIG. 6 and FIG. 7A, the blower fan 80 is provided on the left side (the other side in the first direction) of the container unit 31. In the present embodiment, the blower fan 80 is provided on a left side surface 82A of the guide portion 33L located at the leftmost position in the container unit 31. The blower fan 80 is an air blower electrically driven to blow sucked air. As the blower fan 80, various types of fans such as a sirocco fan, a propeller fan, and an axial-flow fan may be applied. An air intake hole 89 (see FIG. 2) is formed in the left side surface of the housing 14A. The blower fan 80 sucks air through an air inlet 80A from the air intake hole 89, and blows the air through an air outlet 80B to the first air passage 71. FIG. 6, FIG. 7A, and FIG. 7B are views of the image forming portion 14 when an external cover is removed.

The blower fan 80 is driven constantly or at a required timing. In the present embodiment, the blower fan 80 is for cooling the toner containers 3, the transfer belt 5A, the sheet discharge tray 18, and a sheet member on the sheet discharge tray 18. Therefore, preferably, the blower fan 80 is driven during a period since image formation is started until the image formation is finished, or a period since image formation is started until a predetermined time elapses after the image formation is finished.

Figure 8A:
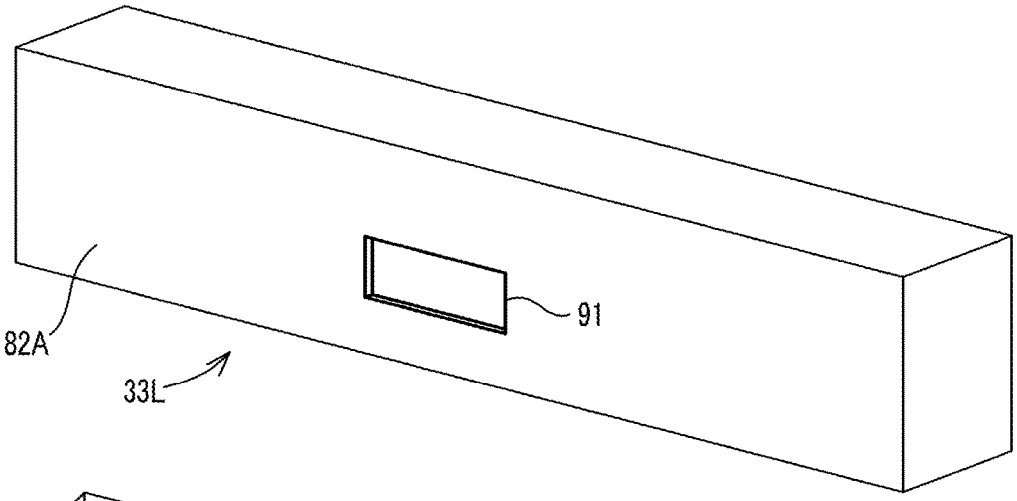
FIG. 8A to FIG. 8C are schematic diagrams schematically showing the configuration of a support guide provided in the image forming portion.

The guide portion 33L is not only for guiding the toner container 3Y but also for guiding air blown from the blower fan 80, to the first air passage 71. The guide portion 33L is formed in a box shape having a space therein. As shown in FIG. 7B and FIG. 8A, a first opening 91 is formed in the left side surface 82A of the guide portion 33L. The blower fan 80 is fixed to the left side surface 82A, with the air inlet 80A directed leftward and with the air outlet 80B directed forward. The first opening 91 is communicated with the internal space of the guide portion 33L. The first opening 91 is located to a front side with respect to the air outlet 80B and substantially at the center in the front-rear direction 7 in the left side surface 82A.

A cover 83 covering a part from the air outlet 80B to the first opening 91 is attached to the left side surface 82A. Here, FIG. 7A shows the state in which the cover 83 is attached, and FIG. 7B shows the state in which the cover 83 is removed. When the cover 83 is attached to the left side surface 82A, the cover 83 forms an air passage from the air outlet 80B to the first opening 91. Thus, air blown from the air outlet 80B of the blower fan 80 is guided to the first opening 91 through the air passage formed between the cover 83 and the left side surface 82A, and then flows to the inside of the guide portion 33L through the first opening 91.

Figure 8B:
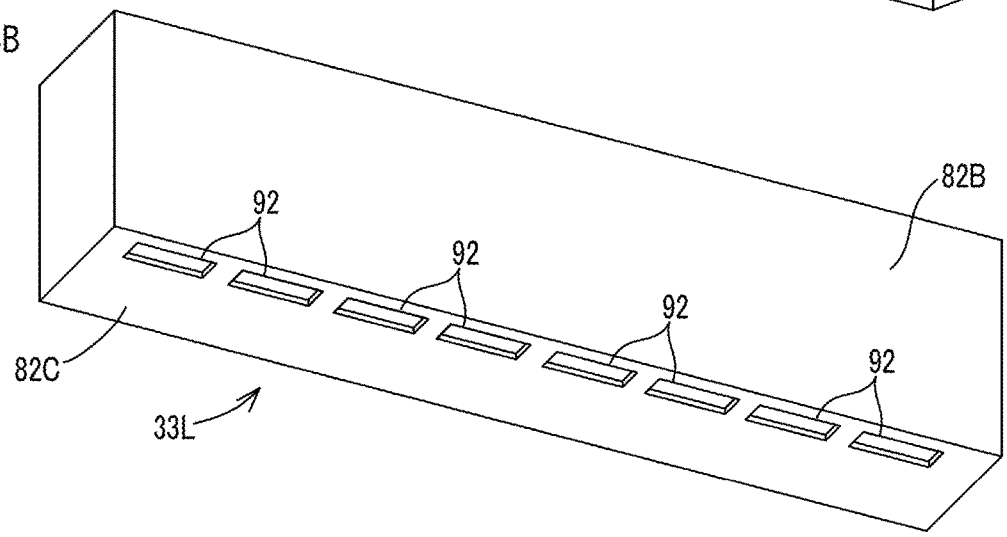
Figure 8C:
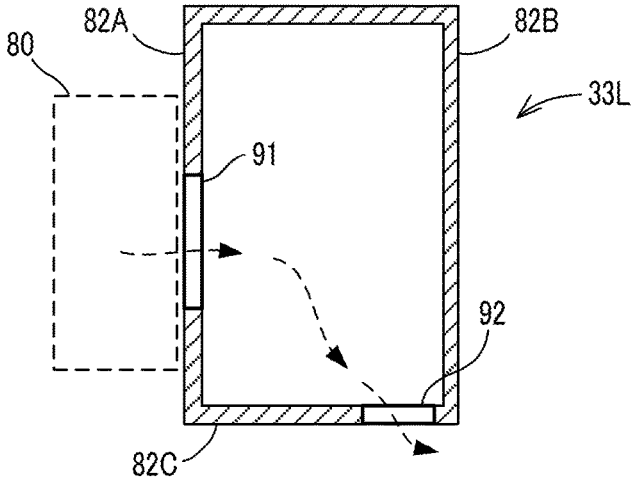

FIG. 8A to FIG. 8C are schematic diagrams showing the guide portion 33L. As shown in FIG. 8B, a plurality of second openings 92 are formed in a bottom surface 82C of the guide portion 33L. In the guide portion 33L, only the first opening 91 and the second openings 92 are formed. Therefore, air flowing into the first opening 91 from the blower fan 80 passes through the internal space of the guide portion 33L to reach the second openings 92, and then flows through the second openings 92 to the outside. That is, the guide portion 33L guides the air flowing into the first opening 91, to the first air passage 71 through the second openings 92. In the present embodiment, the second openings 92 are formed at the right side end in the bottom surface 82C. Therefore, as shown in FIG. 8C, air flowing into the guide portion 33L hardly causes convection inside the guide portion 33L, so that the air stably flows through the second openings 92 to the first air passage 71 without the air flow being disturbed. Since the second openings 92 are formed on the right side in the bottom surface 82C, air is blown obliquely downward to the right from the second openings 92. Therefore, the air blown from the second openings 92 moves rightward in the first air passage 71. The second openings 92 may be provided at the corner between the bottom surface 82C and a right side surface 82B of the guide portion 33L. Instead of the plurality of second openings 92, one opening elongated in the longitudinal direction of the bottom surface 82C may be provided.

Figure 9:
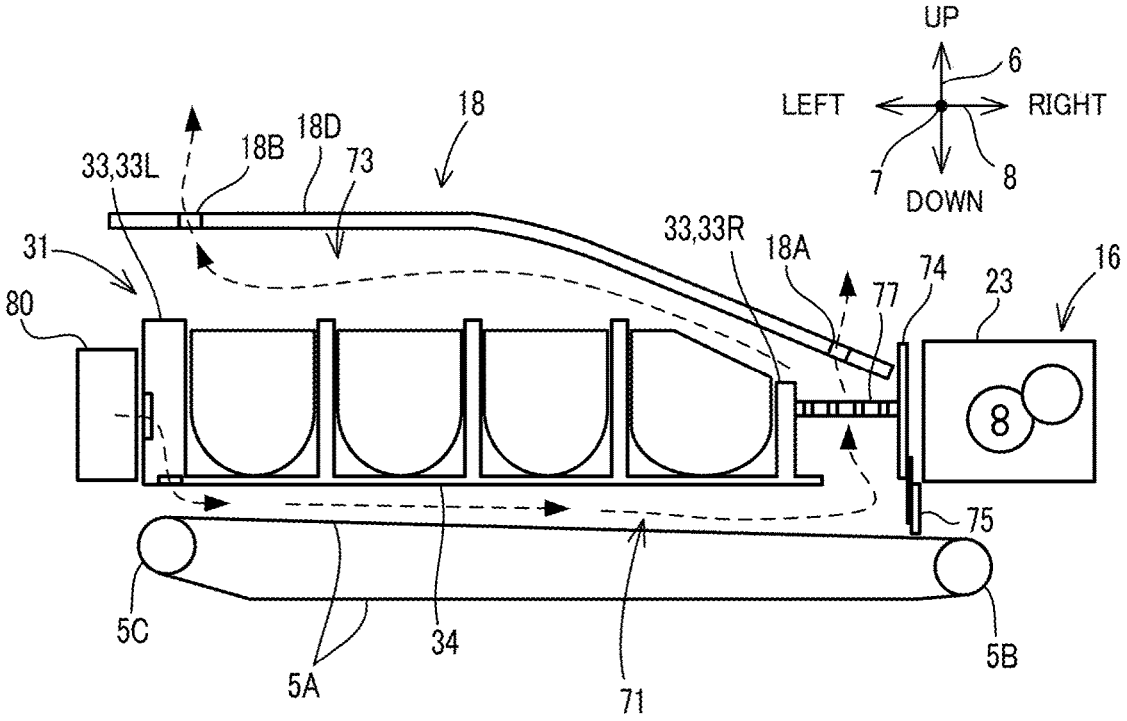
FIG. 9 is a diagram showing flow of air inside the image forming portion.

Since the image forming apparatus 10 according to the present embodiment is thus configured, as shown in FIG. 9, when the blower fan 80 is driven, air flows into the first opening 91 of the guide portion 33L, passes through the inside of the guide portion 33L, and then is blown to the first air passage 71 through the second openings 92. Then, the air blown to the first air passage 71 moves rightward in the first air passage 71. Through this movement, the bottom plate 34 of the container unit 31 and the transfer belt 5A are cooled. By the bottom plate 34 being cooled, bottom portions of the plurality of toner containers 3 mounted in the container unit 31 are cooled. Then, when the air reaches the block portion 75, the direction of the air flow is changed by the block portion 75, so that the air flows toward the second air passage 72. Then, when the air flows from the second air passage 72 into the space 73, a part of the air flows upward through the through holes 18A to be discharged to the sheet discharge space 21. Another part of the air moves leftward in the space 73, and then flows upward through the through holes 18B to be discharged to the sheet discharge space 21. Thus, the heat of a sheet member discharged to the sheet discharge tray 18 is swiftly cooled by the air flow, whereby sheet members are prevented from being adhered to each other by the toner that has been just melted and fixed on the sheet members. When the air moves in the space 73, the air contacts with the top surfaces of the plurality of toner containers 3 and the bottom surface of the sheet discharge tray 18, whereby each surface is cooled and thus the toner containers 3 and the sheet discharge tray 18 are cooled.

In the above embodiment, the case where the guide portion 33L guides air from the blower fan 80 to the first air passage 71 has been described. However, the present disclosure is not limited thereto. For example, as a member separate from the guide portion 33L, an air duct portion for guiding air from the blower fan 80 to the first air passage 71 may be provided between the blower fan 80 and the guide portion 33L.

In the above embodiment, the case where the sheet discharge tray 18 has the plurality of through holes 18A and the plurality of through holes 18B has been described. However, the sheet discharge tray 18 only needs to have either the through hole 18A or the through hole 18B. It is not always necessary to provide both the through hole 18A and the through hole 18B in the sheet discharge tray 18. Without providing the through hole 18A and the through hole 18B, air guided to the second air passage 72 or the space 73 may be allowed to be discharged through gaps at various portions of the housing 14A.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a transfer portion having a transfer belt extending in a predetermined first direction;

a fixing portion provided on one side in the first direction with respect to the transfer portion;

a container mounting portion which is provided so as to be spaced via a first air passage having a predetermined interval in a second direction perpendicular to the transfer belt and perpendicular to the first direction, and in which one or a plurality of toner containers containing a developer are mounted;

an air blower provided on another side in the first direction with respect to the container mounting portion, and configured to send air to the first air passage; and an air duct portion provided between the air blower and the container mounting portion and configured to guide air sent from the air blower, to the first air passage, wherein the air duct portion is capable of supporting a side surface of the toner container, the air duct portion is a guide portion configured to support a side surface on the other side of the toner container so as to allow the side surface to be guided in a third direction perpendicular to the first direction and the second direction, the guide portion is formed in a box shape having a space therein, a side surface on the other side of the guide portion has a first opening, the air blower is attached to the side surface of the guide portion such that an air inlet of the air blower is directed to the other side and an air outlet of the air blower is directed to the first opening side, the guide portion has, in a bottom surface thereof, a second opening through which air flowing inside the guide portion from the first opening is blown obliquely downward, and the second opening is formed at a corner between the bottom surface and a side surface on the one side of the guide portion.

2. The image forming apparatus according to claim 1, wherein the first opening is located to a front side of the image forming apparatus with respect to the air outlet and substantially at a center in the third direction, in the side surface of the guide portion, and is communicated with a space inside the guide portion.

3. The image forming apparatus according to claim 1, further comprising a cover attached to the side surface of the guide portion, covering a part from the air outlet to the first opening, and forming an air passage from the air outlet to the first opening.

4. The image forming apparatus according to claim 1, further comprising a discharged sheet retainer provided on the second direction side with respect to the transfer portion and configured to retain a sheet member that has passed through the fixing portion and has been discharged to outside, wherein the discharged sheet retainer has a communication portion through which a second air passage formed between the container mounting portion and the fixing portion is communicated with the outside, the communication portion being configured to guide air flowing in the second direction through the second air passage from the first air passage to the outside.

5. The image forming apparatus according to claim 4, wherein the communication portion includes a plurality of through holes formed directly above the second air passage, in the discharged sheet retainer, the plurality of through holes being communicated with the second air passage.

6. The image forming apparatus according to claim 5, wherein the plurality of through holes are respectively formed between a plurality of ribs arranged at predetermined intervals in a third direction perpendicular to the first direction and the second direction on a top surface of the discharged sheet retainer.

7. The image forming apparatus according to claim 4, wherein the communication portion includes a plurality of through holes formed at an end on the other side in the discharged sheet retainer, the plurality of through holes being communicated with a space formed between the discharged sheet retainer and a top surface of the toner container.

8. The image forming apparatus according to claim 4, further comprising a partition plate serving as a partition between the second air passage and a space formed between the discharged sheet retainer and a top surface of the toner container.

9. The image forming apparatus according to claim 4, further comprising:

a side plate portion serving as a partition between the second air passage and the fixing portion and forming a side surface on the one side of the second air passage; and a block portion provided at an end on the transfer belt side of the side plate portion, and configured to change flow of air sent from the air blower and passing through the first air passage, to the second air passage, and to block flow of air to the fixing portion.

10. An image forming apparatus comprising:

a transfer portion having a transfer belt extending in a predetermined first direction;

a fixing portion provided on one side in the first direction with respect to the transfer portion;

a container mounting portion which is provided so as to be spaced via a first air passage having a predetermined interval in a second direction perpendicular to the transfer belt and perpendicular to the first direction, and in which one or a plurality of toner containers containing a developer are mounted;

an air blower provided on another side in the first direction with respect to the container mounting portion, and configured to send air to the first air passage; and an air duct portion provided between the air blower and the container mounting portion and configured to guide air sent from the air blower, to the first air passage, wherein the air duct portion is capable of supporting a side surface of the toner container, the air duct portion is a guide portion configured to support a side surface on the other side of the toner container so as to allow the side surface to be guided in a third direction perpendicular to the first direction and the second direction, the guide portion is formed in a box shape having a space therein, a side surface on the other side of the guide portion has a first opening, the air blower is attached to the side surface of the guide portion such that an air inlet of the air blower is directed to the other side and an air outlet of the air blower is directed to the first opening side, the guide portion has, in a bottom surface thereof, a second opening through which air flowing inside the guide portion from the first opening is blown obliquely downward, and the second opening is one opening formed in the bottom surface of the guide portion and elongated in the third direction.

11. An image forming apparatus comprising:

a transfer portion having a transfer belt extending in a predetermined first direction;

a fixing portion provided on one side in the first direction with respect to the transfer portion;

a container mounting portion which is provided so as to be spaced via a first air passage having a predetermined interval in a second direction perpendicular to the transfer belt and perpendicular to the first direction, and in which one or a plurality of toner containers containing a developer are mounted;

an air blower provided on another side in the first direction with respect to the container mounting portion, and configured to send air to the first air passage;

an air duct portion provided between the air blower and the container mounting portion and configured to guide air sent from the air blower, to the first air passage; and a discharged sheet retainer provided on the second direction side with respect to the transfer portion and configured to retain a sheet member that has passed through the fixing portion and has been discharged to outside, wherein the discharged sheet retainer has a communication portion through which a second air passage formed between the container mounting portion and the fixing portion is communicated with the outside, the communication portion being configured to guide air flowing in the second direction through the second air passage from the first air passage, to the outside.

12. The image forming apparatus according to claim 11, wherein the communication portion includes a plurality of through holes formed directly above the second air passage, in the discharged sheet retainer, the plurality of through holes being communicated with the second air passage.

13. The image forming apparatus according to claim 12, wherein the plurality of through holes are respectively formed between a plurality of ribs arranged at predetermined intervals in a third direction perpendicular to the first direction and the second direction on a top surface of the discharged sheet retainer.

14. The image forming apparatus according to claim 11, wherein the communication portion includes a plurality of through holes formed at an end on the other side in the discharged sheet retainer, the plurality of through holes being communicated with a space formed between the discharged sheet retainer and a top surface of the toner container.

15. The image forming apparatus according to claim 14, wherein the plurality of through holes are respectively formed at both ends in a third direction perpendicular to the first direction and the second direction in the discharged sheet retainer.

16. The image forming apparatus according to claim 15, wherein the discharged sheet retainer has: a flat surface located on the other side on a top surface of the discharged sheet retainer; and a support portion located at a central portion in the third direction on the flat surface and having a plurality of ribs arranged at predetermined intervals in the third direction, and the plurality of through holes are respectively formed at both ends in the third direction in the flat surface.

17. The image forming apparatus according to claim 11, further comprising a partition plate serving as a partition between the second air passage and a space formed between the discharged sheet retainer and a top surface of the toner container.

18. The image forming apparatus according to claim 17, wherein the partition plate has a plurality of through holes through which air flowing into the second air passage flows into the space.

19. The image forming apparatus according to claim 11, further comprising:

a side plate portion serving as a partition between the second air passage and the fixing portion and forming a side surface on the one side of the second air passage; and a block portion provided at an end on the transfer belt side of the side plate portion, and configured to change flow of air sent from the air blower and passing through the first air passage, to the second air passage, and to block flow of air to the fixing portion.

20. The image forming apparatus according to claim 19, wherein the block portion has a film member attached to the end of the side plate portion, and a sponge member attached to the film member.

* * * * *